US006874290B1

(12) United States Patent
Bokan

(10) Patent No.: US 6,874,290 B1
(45) Date of Patent: Apr. 5, 2005

(54) SIDING SYSTEM

(76) Inventor: Ted R. Bokan, P.O. Box 174, Ingleside, IL (US) 60041

( * ) Notice: Subject to any disclaimer, the term of this patent is extended or adjusted under 35 U.S.C. 154(b) by 1 day.

(21) Appl. No.: 10/661,291

(22) Filed: Sep. 12, 2003

(51) Int. Cl.[7] ..... E04D 1/34

(52) U.S. Cl. ..... 52/543; 52/478; 52/520; 52/536; 52/546

(58) Field of Search ..... 52/512, 520, 526, 52/527, 528, 543, 545, 546, 549, 551, 357, 712, 714, 547, 550; 248/301; D8/371, 382

(56) References Cited

U.S. PATENT DOCUMENTS 2,126,676 A * 8/1938 Thomas ..... 52/520
3,188,774 A * 6/1965 McCorkle ..... 52/478
3,226,901 A * 1/1966 Harter ..... 52/520
3,473,274 A * 10/1969 Godes ..... 52/127.5
3,593,479 A * 7/1971 Hinds et al. ..... 52/313
3,738,076 A * 6/1973 Kessler ..... 52/547
3,824,756 A * 7/1974 Kessler ..... 52/546
4,054,012 A * 10/1977 Paradisi et al. ..... 52/544
4,272,576 A * 6/1981 Britson ..... 428/100
4,348,849 A * 9/1982 Wollam et al. ..... 52/545
4,669,238 A * 6/1987 Kellis et al. ..... 52/105
4,947,609 A * 8/1990 Champagne ..... 52/545
5,339,608 A * 8/1994 Hollis et al. ..... 52/545
5,349,802 A 9/1994 Kariniemi
5,392,579 A * 2/1995 Champagne ..... 52/520
5,564,246 A * 10/1996 Champagne ..... 52/548
5,606,835 A * 3/1997 Champagne ..... 52/545
6,367,220 B1 * 4/2002 Krause et al. ..... 52/512

* cited by examiner

*Primary Examiner*—Carl D. Friedman
*Assistant Examiner*—Yvonne M. Horton
(74) *Attorney, Agent, or Firm*—Goldstein Law Offices P.C.

(57) ABSTRACT

A siding system which employs a plurality of siding assemblies, each capable of being selectively attached to other siding assemblies in a series. Each siding assembly has a wall bracket for selective attachment to a support structure such as a wall, and an associated siding panel. Each wall bracket is selectively attachable to its own associated siding panel and to the next higher siding panel of the series. When damaged, the individual siding panels are easily detached from the wall brackets and quickly replaced with an undamaged panel.

13 Claims, 2 Drawing Sheets

SIDING SYSTEM

BACKGROUND OF THE INVENTION

1. Field of the Invention

The invention generally relates to a siding system, and in particular relates to a siding system which employs a plurality of siding assemblies, each capable of being selectively attached to other siding assemblies in a series.

2. Description of the Related Art

Siding is an important part of the waterproofing system of a building, and in particular is used for protecting the external surfaces of many millions of homes from damaging environmental factors, including rain, snow, and sunlight. Commonly made of aluminum, and in recent years more commonly made of vinyl, the advantages of siding are many, and include longevity and low maintenance. However, such modular siding has its disadvantages. In particular, installation of siding is a labor intensive and time consuming task. Furthermore, removal of damaged portions of the siding and replacement of the damaged portion with undamaged siding is also a difficult procedure. Accordingly, there is a need for a siding assembly which is provided as a number of interlocking assemblies, each having a wall bracket and an associated siding panel, wherein the siding assemblies are easily installed upon an existing support structure, and wherein damaged panels of the siding assembly are easily removable by a user by simply pulling the panel away from its associated wall bracket and from the wall bracket of the next lower siding assembly in the series.

A variety of siding assemblies have been devised. For example, U.S. Pat. No. 3,188,774 to McCorkle appears to show a metal siding attached with a connector to a frame, wherein individual siding assemblies within a series of the siding assemblies are selectively removable for repair. Additionally, U.S. Pat. No. 5,349,802 to Karinimei appears to show a siding assembly having a fastener using inserts and channels. Moreover, U.S. Pat. No. 3,593,479 to Hinds appears to show a siding assembly capable of interlocking with other similar units, having a tapered bottom edge.

While these devices may be suitable for the particular purpose employed, or general use, they would not be as suitable for the purposes of the present invention as disclosed hereafter.

SUMMARY OF THE INVENTION

It is an object of the invention to provide a siding system that is easily installed onto an existing support structure. Accordingly, the siding system employs a plurality of siding assemblies that each comprise a wall bracket and an associated siding panel. The wall bracket is selectively and easily attached to the support structure, and is capable of selectively engaging its associated siding panel and also the siding panel of the next higher siding assembly in the series, thereby providing a siding assembly which is easily installed onto the existing support structure.

It is another object of the invention to provide a siding assembly having siding panels which are easily replaced when damaged. Accordingly, a damaged panel may be easily removed by a user by pulling the panel away from the wall bracket of the next lower siding assembly in the series, and then by pulling it from its associated wall bracket. After removal of the damaged panel, an undamaged panel is simply inserted in its place.

Further objects of the invention will become apparent in the detailed description of the invention that follows.

The invention is a siding system which employs a plurality of siding assemblies, each capable of being selectively attached to other siding assemblies in a series. Each siding assembly has a wall bracket for selective attachment to a support structure such as a wall, and an associated siding panel. Each wall bracket is selectively attachable to its own associated siding panel and to the next higher siding panel of the series. When damaged, the individual siding panels are easily detached from the wall brackets and quickly replaced with an undamaged panel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
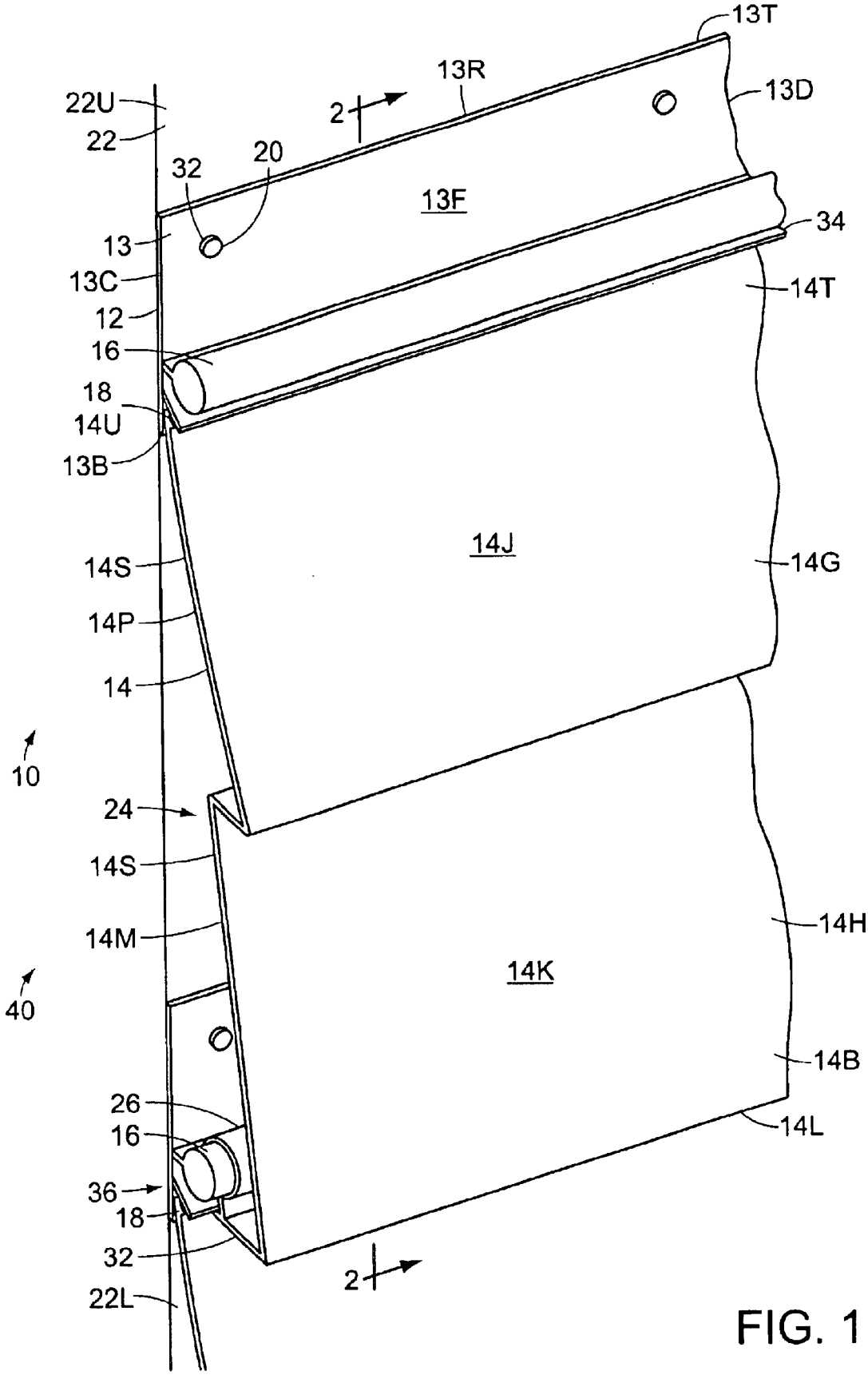
FIG. 1 is a perspective view of two siding assemblies, after selective attachment to a support structure and to one another.

FIG. 1 illustrates a siding system 40, comprised of a plurality of siding assemblies 10. Two such siding assemblies 10 are illustrated in FIG. 1, after selective attachment to one another and to a vertical support structure 22 such as a wall. The vertical support structure 22 has an upper portion 22U and a lower portion 22L. Each siding assembly 10 comprises a wall bracket 12 and an associated siding panel 14 having a top 14T and a bottom 14B. Of the two siding assemblies 10 illustrated, one is uppermost and one is lowermost. The uppermost siding assembly 10 is attached to the support structure 22 by its associated wall bracket 12 at a position which is more proximal to the upper portion 22U of the support structure 22. The lowermost siding assembly 10 is attached to the support structure 22 by its associated wall bracket 12 at a position which is more proximal to the lower portion 22L of the support structure 22. As illustrated, while being deployed to cover the support structure 22, the siding assemblies 10 are arranged in a series, wherein the siding panels 14 of adjacent siding assemblies 10 in the series are arranged in a "head-to-tail" series, wherein the top 14T of one panel 14 substantially abuts the bottom 14B of the next uppermost siding panel 14 in the series. Also as illustrated, after selectively attaching the siding assemblies 10 to the support structure 22, the top 14T of each panel 14 is closer to the upper portion 22U of the support structure 22, and the bottom 14B of each panel 14 is closer to the lower portion 22L of the support structure 22. Each of the two siding panels 14 has been attached to its associated wall bracket 12 by selectively attaching the top 14T of the panel 14 to said wall bracket 12, as will be described in further detail hereinafter. Furthermore, each siding panel 14 is attachable at its bottom 14B to the wall bracket 12 of the next lower siding assembly 10 of the series, as will also be described in further detail.

The wall bracket 12 has a substantially rectangular attachment plate 13 having a top 13T, a bottom 13B, a first side 13C, a second side 13D, a front surface 13F, and a rear surface 13R. The attachment plate 13 has a pair of circular openings 32 extending fully between the front surface 13F and the rear surface 13R. The wall bracket 12 is selectively attached to the support structure 22 by placing the rear surface 13R of the attachment plate 13 flush against the support structure 22, by extending a nail 20 into each of the circular openings 32, and by driving the nails 20 into the support structure 22. Alternatively, the user may use threaded screws to selectively attach the wall brackets 12 to the support structure 22.

The attachment plate 13 of each wall bracket 12 has an outwardly projecting substantially cylindrical flange 16 for selectively engaging the bottom 14B of the siding panel of the next higher siding assembly 10 in the series, as will be described. The wall bracket 12 has a substantially rectangular outwardly projecting lip 34 extending partially downward from the front surface 13F of the attachment plate 13, thereby forming an acute angle with the attachment plate 13. The lip 34 extends at least partially between the first 13C and second sides 13D of the attachment plate 13. The lip 34 extends from the attachment plate 13 at a position between the top 13T and the bottom 13B of the attachment plate 13, thereby forming a substantially triangular tab engagement channel 36 capable of selectively engaging the top 14T of the siding panel 14 associated with that particular wall bracket 12, as will be described.

The siding assembly 10 further comprises a substantially rectangular "double lap" siding panel 14 having an upper flap 14G, a lower flap 14H, and a lateral fold 24 which segments the panel 14 into the upper flap 14G and the lower flap 14H. The panel 14 has a top edge 14U, a bottom edge 14L, and a locking tab 18 in proximity to its top edge 14U. The lower flap 14H has a front surface 14K, a rear surface 14M, and two opposing sides 14S. Analogously, the upper flap 14G has a front surface 14J, a rear surface 14P, and two opposing sides 14S. The substantially triangular locking tab 18 of the siding panel 14 selectively engages the tab engagement channel 36 of its associated wall bracket 12. The locking tab 18 extends at least partially between the sides 14S of the upper flap 14G. In FIG. 1, each of the two siding assemblies 10 has been assembled by the user by attaching each wall bracket 12 to its associated siding panel 14 by selectively inserting the locking tab 18 of the panel 14 into the tab engagement channel 36 of the wall bracket 12. Furthermore, the two siding assemblies 10 have been selectively attached to one another, as will now be described.

Figure 2:
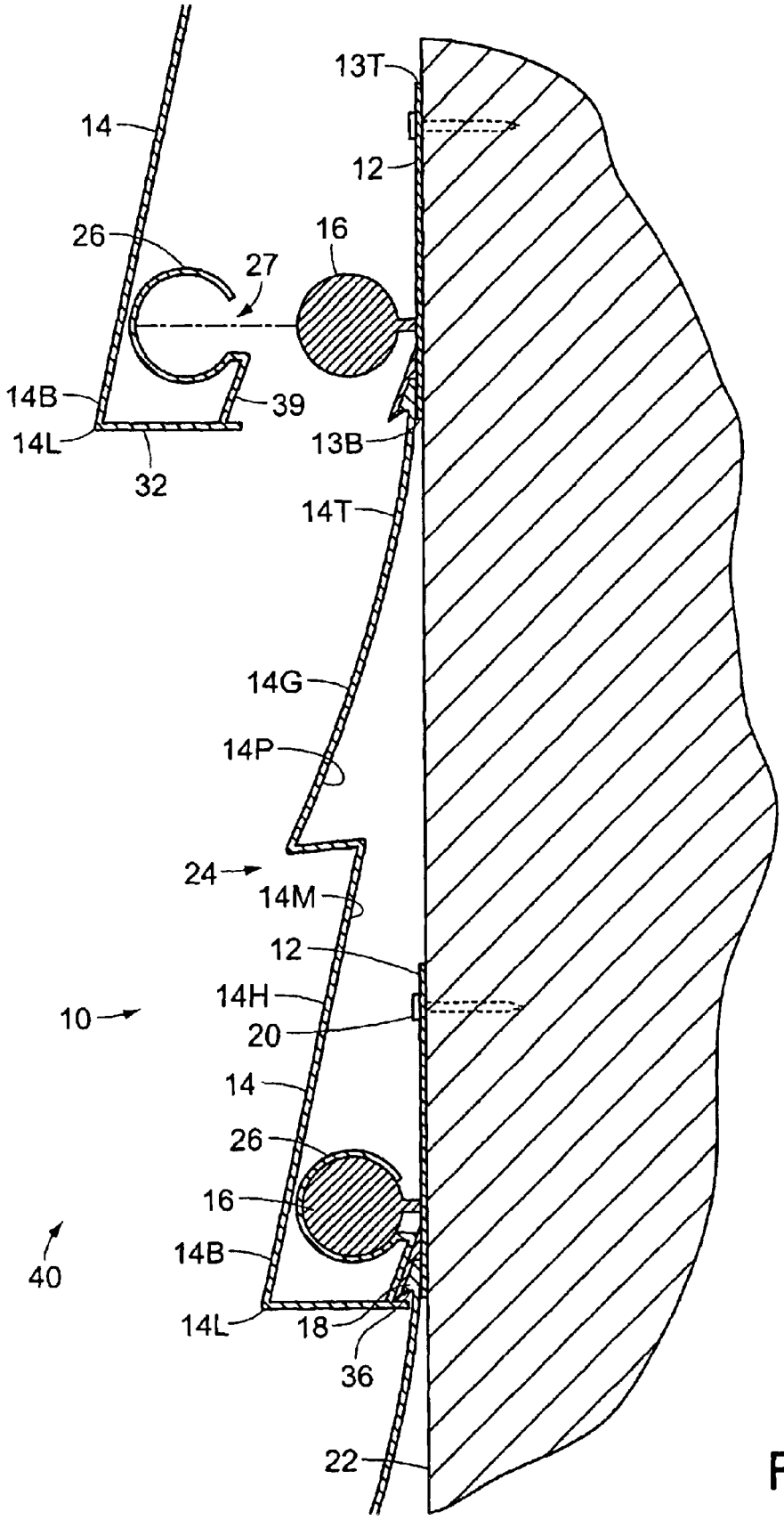
FIG. 2 is a cross-sectional view taken along line 2—2 of FIG. 1, illustrating the two siding assemblies, and additionally illustrating a siding panel of a third siding assembly positioned for selective attachment to the wall bracket of the upper of the two attached siding assemblies.

FIG. 2 illustrates two siding assemblies 10, after selective attachment to the support structure 22 and to each other. FIG. 2 additionally illustrates a third siding panel 14 positioned for selective attachment to the wall bracket 12 of the uppermost of the two siding assemblies 10. In particular, the bottom edge 14L of the panel 14 has a substantially horizontal segment 32 extending inwardly toward the support structure 22, having a diagonal channel attachment piece 39 extending upwardly therefrom. The attachment piece 39 has an attached substantially hollow cylindrical channel 26 having an opening 27, for selectively engaging the outwardly projecting cylindrical flange 16 of the uppermost wall bracket 12. The siding panel 14 is selectively attached to the wall bracket 12 by snapping the cylindrical channel 26 onto the cylindrical flange 16 by the user by pushing the bottom edge 14L of the panel 14 toward the wall bracket 12.

The panels 14 illustrated in both FIG. 1 and FIG. 2 are "double lap" panels, having a lateral fold 24 in the siding panel 14 which segments the panel 14 into a substantially rectangular upper flap 14G and a substantially rectangular lower flap 14H. After selective attachment of the siding assembly 10 to the support structure 22, the rear surface 14P of the upper flap 14G and the rear surface 14M of the lower flap 14H do not substantially contact the support structure 22. Rather, each of the flaps, 14G and 14H, forms an acute angle with the vertical support structure 22, thereby providing a structure ideally configured for effectively shedding rain water and snow, thereby preventing water damage and prolonging the life of the underlying support structure 22. In an alternate embodiment, the siding panels 14 are "single lap" panels. In such an embodiment, the siding panel 14 has no fold 24, and the front surface of the panel 14 comprises one continuous substantially planar surface. In such an embodiment, after selective attachment to the vertical support structure 22, the front surface of the panel 14 extends downward from the vertical support structure 22 at an acute angle, as in the "double lap" embodiment illustrated in the drawing figures, thereby providing a siding assembly 10 capable of effectively shedding rain water and snow.

The siding panels 14 of the siding assemblies 10 are preferably constructed from aluminum or vinyl. The wall brackets 12 are preferably constructed from a strong, durable metal such as vinyl, aluminum, or steel. The siding assemblies 10 are provided in a variety of shapes and sizes, in order to allow the user to choose a siding assembly 10 which is most appropriate for the particular support structure 22 which is to be covered by the siding assemblies 10. The user generally uses a plurality of the siding assemblies 10 in order to substantially cover the vertical support structure 22 with the siding assemblies 10. The precise number of siding assemblies 10 used obviously depends upon the total surface area that the user desires to cover with the siding assemblies 10.

In use, the user assembles the first siding assembly 10 to be attached to the support structure 22 by selectively attaching the siding panel 14 to its associated wall bracket 12 by selectively engaging the locking tab 18 positioned in proximity to the top edge 14U of the siding panel 14 with the tab engagement channel 36 of the associated wall bracket 12. The user attaches the wall bracket 12 to the support structure 22 at a position in proximity to the lower portion 22L of the support structure 22, by extending a nail 20 into each of the two circular openings 32 extending fully from the front surface 13F to the rear surface 13R of the attachment plate 13, and by driving the nails 20 into the support structure 22. The user assembles the next siding panel 14 in the series in the same manner in which the first siding assembly 10 was assembled. The user then attaches said next siding assembly 10 to the first siding assembly 10 by snapping the cylindrical channel 26 located in proximity to the bottom 14B of the panel 14 of said next siding assembly 10 onto the cylindrical flange 16 of the wall bracket 12 of the first siding assembly 10. The user then attaches the wall bracket 12 of said next siding assembly 10 to the support structure 22 in the same manner used for attaching the wall bracket 12 of the first siding assembly 10 to the support structure 22. The user repeats the steps of assembling a given siding assembly 10 and attaching the siding assembly 10 to the support structure 22 and to the next lower siding assembly 10 in the series, until the support structure is covered by the requisite number of siding assemblies 10. In the event of subsequent damage to one of the siding panels 14, the damaged siding panel 14 is easily removed by the user from its associated wall bracket 12 and from the wall bracket 12 of the next lower siding assembly 10 in the series, by pulling the bottom 14B of the damaged panel 14 away from the support structure 22 and thereby disengaging the cylindrical channel 26 of the damaged panel 14 from the cylindrical flange 16 of the wall bracket 12 of the next lower siding assembly 10 in the series, and by disengaging the locking tab 18 positioned in proximity to the top edge 14U of the damaged panel 14 from the tab engagement channel 36 of its associated wall bracket 12. The user then selectively attaches an undamaged siding panel 14 to the wall bracket 12 associated with the damaged panel 14, and to the wall bracket 12 of the next lower siding assembly 10 in the series, by first engaging the locking tab 18 of the undamaged panel 14 with the tab engagement channel 36 of the wall bracket 12 associated with the damaged panel 14, and then by pushing the bottom of the panel 14 towards the support structure 22, thereby engaging the cylindrical channel 26 of the undamaged panel 14 with the cylindrical flange 16 of the wall bracket 12 of the next lower siding assembly 10 in the series.

In conclusion, herein is presented a siding system, comprised of a plurality of substantially identical siding assemblies, for selective attachment to an existing vertical support structure. The invention is illustrated by example in the drawing figures, and throughout the written description. It should be understood that numerous variations are possible, while adhering to the inventive concept. Such variations are contemplated as being a part of the present invention.

What is claimed is:

1. A siding system, for use by a user with a support structure having an upper portion and a lower portion, for protecting the support structure from damaging environmental effects, comprising a plurality of substantially identical siding assemblies, wherein while being deployed to cover the support structure, the plurality of siding assemblies are arranged in a series, wherein the next higher of any two siding assemblies of the series is attached to the support structure at a position which is closer to the upper portion of the support structure, and wherein the next lower of any two siding assemblies of the series is attached to the support structure at a position which is closer to the lower portion of the support structure, each siding assembly comprising:

a wall bracket having an attachment plate having a top, a bottom, a first side, a second side, a front surface, and a rear surface, wherein said attachment plate is selectively attachable to the vertical support structure, said attachment plate having a flange which projects outward from its front surface for selectively engaging the next higher siding assembly in the series, said flange is substantially cylindrical and extends longitudinally between the first and second side, said wall bracket having an outwardly projecting lip extending partially downward from the front surface of the attachment plate at an acute angle to the attachment plate, said lip extending at least partially between the first and second sides of the attachment plate at a position between the top and the bottom of the attachment plate, thereby forming a tab engagement channel; and an associated siding panel, selectively attachable to its own wall bracket and to the wall bracket of the next lower siding assembly in the series, said siding panel having a front surface, a rear surface, a top, a bottom, a top edge, a bottom edge, and a locking tab in proximity to its top edge for selectively engaging the tab engagement channel of its associated wall bracket, wherein the locking tab extends at least partially between the sides of the top of the panel, and wherein the bottom edge of the panel has an inwardly extending substantially cylindrical and substantially hollow channel having an opening, wherein said siding panel is selectively attached to the wall bracket of the next lower siding assembly in the series by snapping the channel onto the flange of said wall bracket by the user pushing the bottom edge of the panel toward the wall bracket, wherein after selective attachment of the plurality of siding assemblies to the support structure, the siding panels of adjacent siding assemblies in the series are arranged in a head-to-tail series, wherein the top of each siding panel substantially abuts the bottom of the next siding panel in the series, and wherein the top of each panel is more proximal to the upper portion of the support structure, and the bottom of each panel is more proximal to the lower portion of the support structure.

2. The siding assembly as recited in claim 1, wherein the tab engagement channel is substantially triangular, and wherein the locking tab that selectively engages the tab engagement channel is substantially triangular.

3. The siding assembly as recited in claim 2, wherein the lip of the wall bracket is substantially rectangular.

4. The siding assembly as recited in claim 3, wherein the attachment plate has at least one opening extending fully between the front surface and the rear surface, wherein the wall bracket is selectively attached to the support structure by placing the rear surface of the attachment plate flush against the support structure, by extending a nail into each of the at least one openings, and by driving the at least one nail into the support structure.

5. The siding assembly as recited in claim 4, wherein the siding panel is substantially constructed from a material selected from aluminum and vinyl.

6. The siding assembly as recited in claim 5, wherein the wall bracket is substantially constructed from a strong, durable metal.

7. The siding assembly as recited in claim 6, wherein the siding panel has a substantially horizontal segment extending inwardly toward the support structure, and also a channel attachment piece extending upwardly from the horizontal segment, wherein the channel is attached to the bottom edge of the panel by the channel attachment piece, and by the substantially horizontal segment.

8. The siding assembly as recited in claim 7, wherein the siding panel is a substantially rectangular double lap siding panel having an upper flap, a lower flap, and a lateral fold which segments the panel into the upper flap and the lower flap, wherein each of the flaps has a front surface, a rear surface, and two opposing sides.

9. The siding assembly as recited in claim 8, wherein after selective attachment of the siding assembly to the support structure, the rear surface of the upper flap and the rear surface of the lower flap do not substantially contact the support structure, and wherein each of the flaps forms an acute angle with the vertical support structure, thereby providing a siding assembly more capable of protecting the support structure from damaging environmental effects.

10. The siding assembly as recited in claim 7, wherein the siding panel is a single lap panel having no fold, wherein the front surface of the panel comprises one continuous substantially planar surface, and wherein after selective attachment of the siding assembly to the support structure, the front surface of the panel extends downward from the vertical support structure at an acute angle to the support structure, thereby providing a siding assembly more capable of protecting the support structure from damaging environmental effects.

11. A method of installing a siding system upon a support structure having an upper portion and a lower portion, using a plurality of substantially identical siding assemblies for at least partially covering the support structure, each of said siding assemblies having a wall bracket having an attachment plate having a front surface and a rear surface, said attachment plate having a flange which projects outward from its front surface, said wall bracket having an outwardly projecting lip extending partially downward from the front surface of the attachment plate at an acute angle to the attachment plate, thereby forming a tab engagement channel, said siding assembly also having an associated siding panel, said siding panel having a front surface, a rear surface, a top, a bottom, a top edge, a bottom edge, and a locking tab in proximity to its top edge, wherein the bottom edge of the panel has an inwardly extending substantially hollow channel having an opening, and wherein after selective attachment to the support structure, the top of each panel is more proximal to the upper portion of the support structure, and the bottom of each panel is more proximal to the lower portion of the support structure, said method comprising the steps of:

assembling the first siding assembly to be attached to the support structure by attaching the siding panel of the first siding assembly to its associated wall bracket by engaging the locking tab positioned in proximity to the top edge of the siding panel with the tab engagement channel of the wall bracket;

attaching the rear surface of the attachment plate to the support structure, with the top of the attachment plate more proximal to the upper portion of the support structure;

assembling the next siding assembly in the series, in the same manner in which the first siding assembly was assembled;

attaching said next siding assembly in the series to the first siding assembly by engaging the channel located in proximity to the bottom of the panel of said next siding assembly with the flange of the wall bracket of the first siding assembly;

attaching the wall bracket of said next siding assembly in the series to the support structure; and repeating the steps of assembling a given siding assembly and attaching the siding assembly to the previously attached siding assembly and the support structure, until the support structure is at least partially covered by the siding assemblies.

12. The method of installing a siding system as recited in claim 11, further comprising the steps of:

removing the panels as they become damaged by pulling the bottom of the damaged panel away from the support structure and thereby disengaging the channel of the damaged panel from the flange of the wall bracket of the next lower siding assembly in the series, and by disengaging the locking tab positioned in proximity to the top edge of the damaged panel from the tab engagement channel of its associated wall bracket; and selectively attaching an undamaged siding panel to the wall bracket associated with the damaged panel and to the wall bracket of the next lower siding assembly in the series, by first engaging the locking tab of the undamaged panel with the tab engagement channel of the wall bracket associated with the damaged panel, and then by engaging the channel of the undamaged panel with the flange of the wall bracket of the next lower siding assembly, by pushing the bottom of the panel towards the support structure.

13. The method of installing a siding system as recited in claim 12, wherein the attachment plate has at least one opening extending fully between the front surface and the rear surface of the attachment plate, wherein the step of attaching the wall bracket to the support structure comprises attaching the wall bracket to the support structure by placing the rear surface of the attachment plate flush against the support structure, by extending a nail into each of the at least one openings, and by driving the at least one nail into the support structure.

* * * * *